US005647082A

United States Patent [19]

Garske et al.

[11] Patent Number: 5,647,082

[45] Date of Patent: Jul. 15, 1997

[54] GOLF BALL WASHING DEVICE WITH INTERNAL OVERFLOW

[75] Inventors: Stephen J. Garske, St. Paul; Thomas H. Illies, Blaine, both of Minn.

[73] Assignee: Par Aide Products Co., St. Paul, Minn.

[21] Appl. No.: 572,065

[22] Filed: Dec. 14, 1995

[51] Int. Cl.[6] ..... A46B 11/00

[52] U.S. Cl. ..... 15/21.2; 15/104.92; 29/434; 29/525.11

[58] Field of Search ..... 15/21.2, 104.92, 15/97.1, 160; 29/434, 525.11; 134/6, 8, 186

[56] References Cited

U.S. PATENT DOCUMENTS

| | | | |
|---|---|---|---|
| 2,016,110 | 10/1935 | Heisser | 15/21.2 |
| 2,807,037 | 9/1957 | Garske | 15/21.2 |
| 3,268,934 | 8/1966 | Postula et al. | 15/21.2 |
| 3,304,659 | 2/1967 | Eichhorn | 15/21.2 |
| 3,400,416 | 9/1968 | Nicholson et al. | 15/21.2 |
| 3,748,676 | 7/1973 | Warren et al. . | |
| 3,981,039 | 9/1976 | Rumph . | |
| 4,011,619 | 3/1977 | Michalak . | |
| 4,163,299 | 8/1979 | Duda . | |
| 4,344,203 | 8/1982 | Gerrick . | |
| 4,381,574 | 5/1983 | Benkovsky . | |
| 4,701,968 | 10/1987 | Stoltzman . | |
| 4,899,413 | 2/1990 | Trobiani . | |
| 4,965,906 | 10/1990 | Mauro | 15/21.2 |

FOREIGN PATENT DOCUMENTS

| | | | |
|---|---|---|---|
| 183006 | 6/1966 | U.S.S.R. | 15/21.2 |

*Primary Examiner*—David Scherbel
*Assistant Examiner*—Terrence Till
*Attorney, Agent, or Firm*—Kinney & Lange, P.A.

[57] ABSTRACT

A golf ball washing device is provided which includes an internal overflow. The golf ball washing device includes a shell having an cavity which holds cleaning liquid, an agitator movably connected within the cavity, a stand having a hollow portion attached to the shell, and an overflow passage. In preferred embodiment, the overflow passage is a tube having a first end which is connected to the cavity and a second end which communicates with the hollow portion of the stand. The shell is cast to encase the overflow passage. During use, when the agitator mechanism causes the cleaning liquid to splash or otherwise rise above its normal level within the cavity, the overflow passage drains the excess cleaning liquid from the cavity into the stand. With this configuration, the overflow passage prevents cleaning liquid from spilling or splashing outside of the shell.

20 Claims, 2 Drawing Sheets

GOLF BALL WASHING DEVICE WITH INTERNAL OVERFLOW

BACKGROUND OF THE INVENTION

The present invention relates to a golf ball washing device. More particularly, it relates to a stand-alone, manually operated golf ball washing device having an internal overflow which eliminates splashing or draining of excess cleaning liquid outside of the device.

Stand-alone golf ball washers are available at virtually every golf course. It is commonplace to find at least one golf ball washer before each hole on a golf course, in close proximity to the tee box. In fact, from exclusive country dubs to public par-three courses, golfers expect to find a golf ball washer on every hole.

Golf ball washers serve a relatively basic function; namely, to remove dirt and other debris from the surface of a golf ball which might otherwise affect the trajectory, distance, etc., of the golf ball after being struck. To accomplish this purpose, stand-alone golf ball washers come in many different forms. In its most basic form, a stand-alone golf ball washer includes a shell, having an inner cavity which holds cleaning liquid and a variety of brushes, and an agitator mechanism movably secured within the shell that allows the golfer to insert and maneuver the golf ball within the cavity so that the brushes and cleaning liquid Can remove the unwanted debris. The agitator mechanism normally passes through an opening in the cover of the shell. Finally, the shell itself is attached to a stand which firmly holds the shell at a certain distance off of the ground.

In addition to the basic golf ball washing device, a towel is often attached to the exterior of the shell and/or the stand and is used by the golfer to dry the golf ball after being washed. Other useful devices, such as golf shoe spike cleaners, garbage cans, score card holders, hole descriptions, advertisements, etc., can also be affixed to the stand.

As previously described, the shell maintains a number of brushes along with a cleaning liquid. To enhance the effectiveness of the golf ball washer, the cleaning liquid will often include a soap-like substance which may foam during use.

After the shell has been filled to a predetermined level with the cleaning liquid, the golf ball washer is ready for use. A golfer simply inserts his or her golf ball, via the agitator mechanism, into the shell. The agitator mechanism, and therefore the golf ball, is then vigorously maneuvered within the shell. This motion causes the cleaning liquid and brushes to interact with the outer surface of the golf ball, washing away unwanted debris.

While a standard golf ball washer will produce a clean golf ball, a separate, undesirable effect also occurs. The cleaning motion of the agitator mechanism within the shell often causes the cleaning liquid to overflow through the opening in the shell cover. Additionally, when certain soap solutions are used, the agitator mechanism may cause foaming to occur, which can likewise overflow. This overflow of cleaning liquid can and will spill over the exterior of the shell, resulting in water damage to the various articles maintained on the shell and/or stand, such as the previously described towel, score cards, advertisements, etc. Further, the overflow of cleaning liquid can drip onto the golfer's shoes or directly onto the golfer. Finally, the soap solution can leave an unsightly residue on the exterior of the shell.

The cleaning liquid overflow problem has but has never fully been solved. The design constraints associated with aluminum or plastic shell golf ball washers have restricted the solutions available. There does not exist a golf ball washer which has the ability to internally drain excess cleaning liquid. Therefore, a substantial need exists for a stand-alone golf ball washer having an internal means for preventing the overflow of cleaning liquid onto the exterior of the washer shell.

SUMMARY OF THE INVENTION

The invention provides a stand-alone golf ball washer having an internal overflow tube. The golf ball washing device of the present invention is comprised of a shell having an inner cavity, an overflow passage, an agitator mechanism and a stand, at least a portion of which is hollow.

The basic construction of the golf ball washer is known. The inner cavity of the shell maintains cleaning liquid and, if desired, a plurality of cleansing brushes. The agitator mechanism is movable within the inner cavity, having a handle portion which projects outwardly from the shell. The shell has an opening through which a portion of the agitator mechanism passes for maneuvering a golf ball within the inner cavity of the shell. The shell is attached to the stand which resultingly maintains the shell in an upright position at a certain distance from the ground.

The present invention improves upon this basic design by adding the overflow passage. A first end of the overflow passage is connected to the inner cavity of the shell, while a second end communicates with the hollow portion of the stand. In the preferred embodiment, the overflow passage is a tube which is encompassed by an outer wall of the shell so that it cannot be seen. With this configuration, when the cleaning liquid within the inner cavity of the shell reaches a certain level, the liquid drains from the inner cavity, through the overflow passage or tube, into the hollow portion of the stand. Thus, excess liquid does not spill over the exterior portion of the shell, but instead passes into the hollow portion of the stand where it can later be drained and/or allowed to evaporate.

DETAILED DESCRIPTION OF THE PREFERRED EMBODIMENTS

Figure 1:
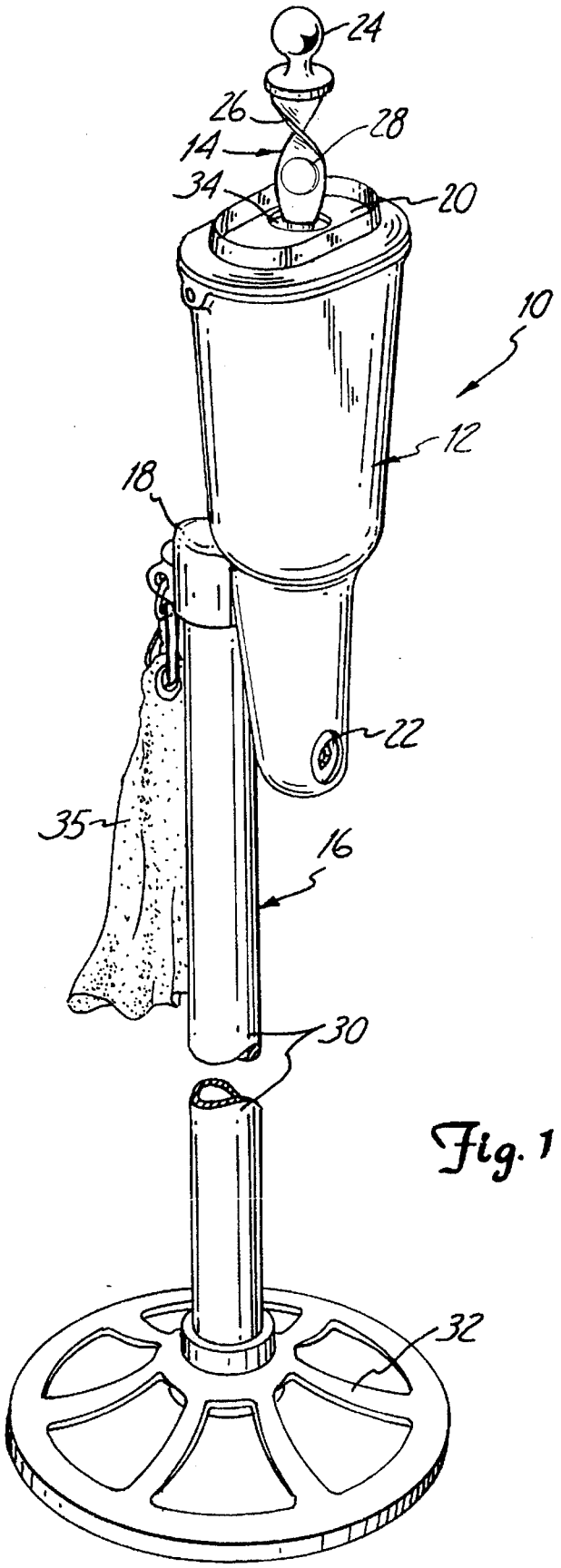
FIG. 1 is a perspective view of a preferred embodiment of the golf ball washer of the present invention.

A preferred embodiment of a golf ball washer 10 is shown in FIG. 1. The golf ball washer 10 is comprised of a shell 12, an agitator 14 and a stand 16. The shell 12 preferably includes a shoulder portion 18, a cover 20 and a drain plug 22. The agitator 14 includes a handle 24, and a helical arm 26 having an aperture 28 sized to receive a golf ball (not shown). The stand 16 includes a hollow post 30 and a base 32.

As will later be described in more detail, the agitator 14 is movably positioned within the shell 12. The handle 24 is rotatably attached to the helical arm 26 which in turn passes through an opening 34 (shown partially in FIG. 1) in the cover 20. This configuration allows a golfer to insert a golf ball into the aperture 28 and maneuver the agitator 14 and golf ball up and down within the shell 12.

The shell 12 is attached to the stand 16 at the shoulder portion 18. More particularly, the shoulder portion 18 receives the hollow post 30 and is mounted thereon. The hollow post 30 is attached to the base 32 to support the shell 12 in an upright position. In this upright position, the shell 12 is easily accessed by a golfer. In a preferred embodiment, a towel 35 is attached to the shoulder portion 18.

While the stand 16 is shown a preferably including the hollow post 30 and the base 32, many other configurators are equally acceptable. For example, the stand 16 may simply be an upright pipe placed in the ground. Alternatively, the stand 16 can be a longer or smaller structure or have a different shape than otherwise shown in FIG. 1, such as a square-shaped column. The only requirement is that the stand 16 maintain the shell 12 in an upright position, and that at least a portion of the stand 16 is hollow for the reasons described below.

Figure 2:
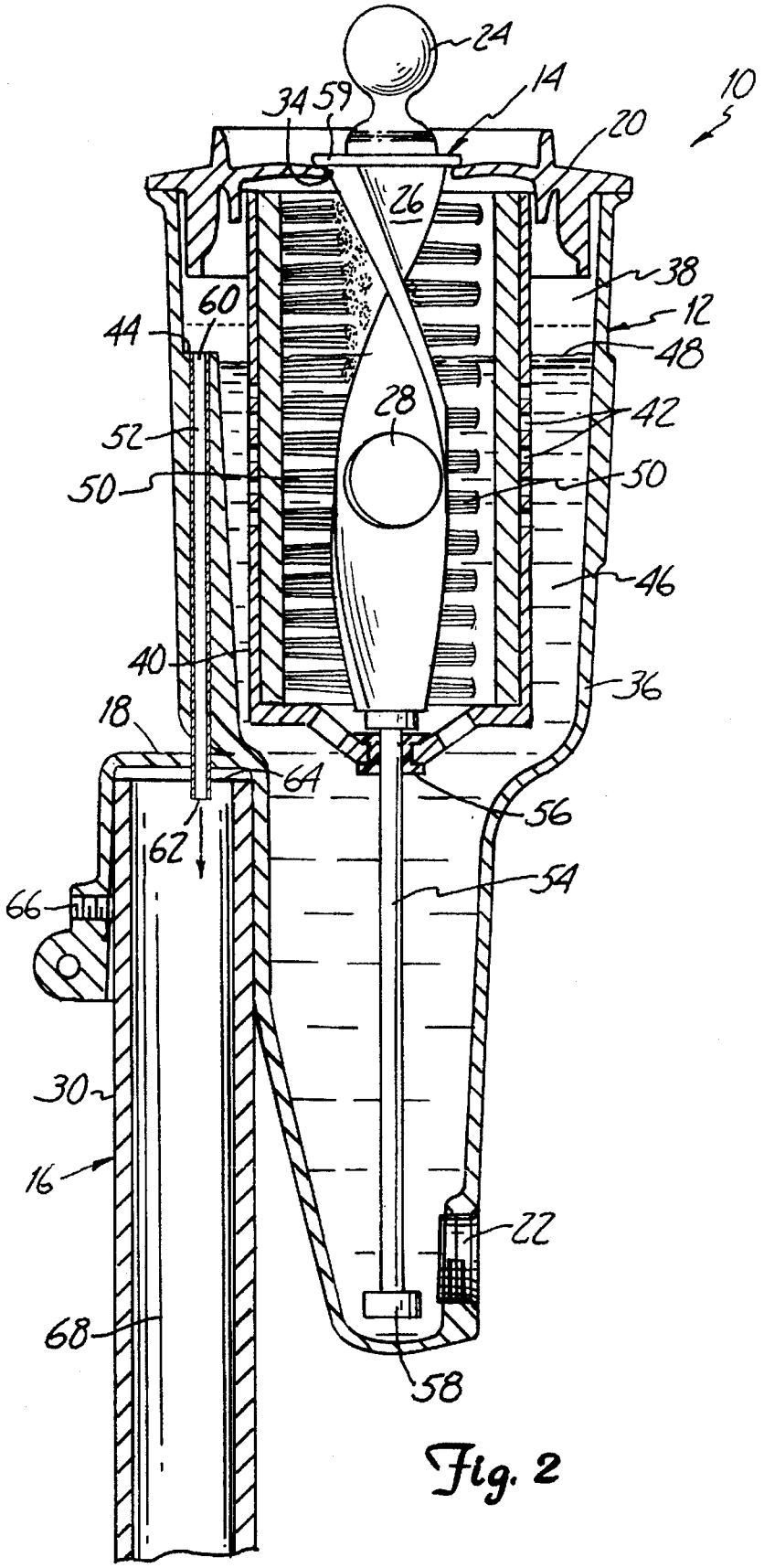
FIG. 2 is a sectional view of the golf ball washer having an overflow tube in accordance with the present invention.

As shown with more detail in FIG. 2, the shell 12 includes an outer wall 36 which defines a cavity 38. Where the outer wall 36 forms the shoulder portion 18, a recess 39 is created. A brush housing 40, having a plurality of small openings 42, is secured within the cavity 38. Along a side of the shell 12, the outer wall 36 defines a lip 44. The cavity 38 maintains cleaning liquid (shown generally as 46) at a first level 48. A plurality of brushes 50 are attached to the brush housing 40. Finally, the shell 12 encompasses an overflow tube 52.

The agitator 14 includes a rod 54 maintained centrally within the cavity 38 by a carriage 56. The rod 54 is attached to the helical arm 26 and includes a stop ring 58. Finally, the helical arm 26 has a flange 59, having a diameter greater than the opening 34 in the cover 20.

The overflow tube 52 is cast within the outer wall 36 of the shell 12 and has a first end 60 and a second end 62. The first end 60 of the overflow tube 52 is connected to the lip 44 of the outer wall 36. The overflow tube 52 passes through the outer wall 36, with the second end 62 terminating beyond a lower edge 64 of the outer wall 36.

As previously described, the various components of the golf ball washer 10 are assembled such that the cover 20 is attached to the shell 12. The agitator 14 is movably connected within the shell 12, with the helical arm 26 passing thought the opening 34 in the cover 20. The hollow post 30 nests within the shoulder portion 18 and is secured by a set screw 66. With this arrangement, the second end 62 of the overflow tube 52 projects into an internal area 68 of the hollow post 30.

The shell 12 is preferably made of cast aluminum but can be formed of any other durable material such as plastic. The agitator 14 is preferably made of plastic. However, any other stiff, water resistant material is equally acceptable. The overflow tube 52 is preferably stainless steel but can be made of other corrosion resistant materials, such as copper. Finally, the hollow post 30 is preferably an aluminum pipe, but can any other type of corrosion resistant material.

Prior to use, the cavity 38 is filled with the cleaning liquid 46 to the first level 48. The cleaning liquid 46 flows through the plurality of small openings 42 in the brush housing 40, thus completely filling the cavity 38. To clean a golf ball (not shown), the agitator 14 is raised to a loading position (as shown in FIG. 1) and a golf ball is inserted into the aperture 28. With the preferred design, in the loading position, the stop ring 58 contacts the carriage 56 to prevent the agitator 14 from being completely removed from the shell 12. The user (not shown) then presses downward on the handle 24 causing the helical arm 26 to move downward in a helical fashion. When depressed to its lowest position (shown in FIG. 2), the helical arm 26, and the aperture 28 (and therefore the golf ball contained therein) are fully submersed in the cleaning liquid 46. The flange 59 contacts the cover 20 to stop the downward motion of the agitator 14. The golf ball is then cleaned by maneuvering the agitator 14 in a vertical, up-and-down motion, whereby the golf ball contacts the plurality of brushes 50 and the cleaning liquid 46.

During this cleaning motion, the helical arm 26 of the agitator 14 lifts or splashes the cleaning liquid 46 above the first level 48. This splashing action causes the cleaning liquid 46 to fall onto the lip 44 of the outer wall 36. When this occurs, the cleaning liquid 46 passes into the first end 60 of the overflow tube 52. Gravity forces the cleaning liquid 46 through the overflow tube 52 to the second end 62 and then into the internal area 68 of the hollow post 30. The cleaning liquid 46 within the hollow post 30 accumulates at a lower portion (not shown), where it is later removed by draining or evaporation.

While the preferred embodiment has the overflow tube 52 projecting into the internal area 68 of the hollow post 30, other designs are equally acceptable. For example, the overflow robe 52 could be positioned such that the second end 62 terminates within the recess 39 of the shoulder portion 18 at a point above the hollow post 30. Alternatively, the second end 62 of the overflow robe 52 can be flush with the lower edge 64 of the outer wall 36. With any of the designs, the overflow robe 52 directs excess cleaning liquid 42 through the recess 39 and not the internal area 68 of the hollow post 30. Even further, the outer wall 36 can be designed such that the hollow post 30 abuts the lower edge 64. With this design, the second end 62 of the overflow tube 52 can be flush with the lower edge 64 or can project into the internal area 68 of hollow post 30. The only requirement is that the second end 62 of the overflow robe communicate with the hollow post 30 to deliver cleaning liquid 42 into the internal area 68.

The overflow robe 52 prevents any of the excess cleaning liquid 46 from splashing outside of the cavity 38. Further, when the cleaning liquid 46 foams, this foam will drain through the overflow robe 52 as opposed to exiting through the opening 34 in the cover 20. Thus, the cleaning liquid 46 will not splash onto the exterior of the shell 12.

The golf ball washing device 10 of the present invention is manufactured by first forming the overflow robe 52. The overflow robe 52 is cast within the shell 12 such that the first end 60 of the overflow robe 52 communicates with the cavity 38 of the shell 12. Further, the shell 12 includes the shoulder portion 18 which is designed to receive the hollow post 30. When the hollow post 30 is placed within the shoulder portion 18, the second end 62 of the overflow tube 52 is connected to the internal area 68 of the hollow post 30. The cover 20 (having the opening 34) is attached to the shell 12. Finally, the agitator 14 is placed through the opening 34 in the cover 20 and is movably secured within the cavity 38 of the shell 12. In the preferred embodiment, the shell 12 includes the brush housing 40 to which the plurality of brushes 50 are attached. In an alternative embodiment, the golf ball washing device 10 includes a sediment trap which assists in removing debris from the cleaning liquid.

The golf ball washing device 10 of the present invention overcomes the spillage problem encountered with most stand-alone golf ball washers. The overflow tube directs excess cleaning liquid, which would otherwise spill outside of the shell, into the hollow post. The excess cleaning liquid which accumulates within the post can then be drained or allowed to evaporate. The water damage associated with most stand alone golf ball washers, such as splashing onto the towels, other attachments to the golf ball washer, golfer's shoes, etc., is avoided. The present invention is unique in that previous manufacturing technology did not allow an overflow tube to be cast within the walls of the shell. By providing an overflow tube within a shell (which is preferably cast aluminum) the golf ball washing device of the present invention is durable and can withstand vandalism, irate golfers, and freeze damage.

Although the present invention has been described with reference to preferred embodiments, workers skilled in the art will recognize that changes may be made in form and detail without departing from the spirit and scope of the invention. For example, the agitator need not be a helical shaped arm which is maneuvered in a vertical fashion. Instead, it can be a circular shaped agitator having a handle which is rotated. Also, the cover need not be an element entirely separate from the shell. Instead, the shell and the cover can be formed as a single piece. Further, while the overflow tube has been described as being a body which is entirely separate from the shell, it can instead be a passage proceeding from the cavity of the shell through the shoulder portion and terminating at a position which communicates with the hollow post. To manufacture a golf ball washing device incorporating a passage, the shell is cast with a pin or other solid body running from the cavity to the point of connection with the hollow post. After the shell is cast, the pin is removed, resulting in a defined passage which allows excess cleaning liquid to drain from the cavity to the hollow post once it is attached.

The wall of the shell need not have a lip, but instead the overflow tube or passage can be configured to receive excess cleaning liquid from the cavity. The overflow tube need only be positioned such that its first end is above the first level of the cleaning liquid. Additionally, the overflow tube can drain excess cleaning liquid to a location separate from the stand. Finally while the golf ball washing device has been described as preferably including a plurality of brushes, the brushes are not required. A golf ball washing device in accordance with the present invention can be made without brushes, utilizing cleaning liquid alone to clean a golf ball.

What is claimed is:

1. A golf ball washing device comprising:

a shell having a cavity for holding liquid;

an overflow passage having a first end connected to the cavity for receiving liquid from the cavity and having a second end extending therefrom;

a stand having a hollow portion attached to the shell, wherein the second end of the overflow passage delivers liquid into the hollow portion; and an agitator mechanism movable with respect to the shell for maneuvering a golf ball within the cavity.

2. The golf ball washing device of claim 1 wherein the cavity is defined by an outer wall of the shell, the outer wall including a lip which engages the first end of the overflow passage.

3. The golf ball washing device of claim 1 wherein the cavity maintains liquid at a first level and the first end of the overflow passage is connected to the cavity at a second level, and further wherein the second level is above the first level.

4. The golf ball washing device of claim 1 wherein the shell is cast and has an outer wall which includes the overflow passage.

5. The golf ball washing device of claim 1 wherein the shell is cast and has an outer wall, the outer wall forming a shoulder portion which includes the overflow passage.

6. The golf ball washing device of claim 5 wherein the shoulder portion receives an upper end of the stand.

7. The golf ball washing device of claim 1 wherein the overflow passage is a tube.

8. The golf ball washing device of claim 7 wherein the overflow tube has a lower end which projects outwardly from the shell.

9. The golf ball washing device of claim 7 wherein the overflow tube is stainless steel.

10. The golf ball washing device of claim 1 wherein the stand comprises:

a pipe having an upper end and a lower end, the upper end being attached to the shell; and a platform attached to the lower end of the pipe for maintaining the shell in an upright position.

11. The golf ball washing device of claim 1 wherein a top portion of the shell is open for providing access to the cavity, the device further comprising:

a cover secured to the top portion of the shell.

12. The golf ball washing device of claim 1 wherein the cavity is defined by an outer wall, the outer wall further forming a shoulder portion adjacent to the cavity, the shoulder portion being sized to receive the stand, and further wherein the overflow passage passes through the shoulder portion.

13. The golf ball washing device of claim 1, further comprising:

a brush housing attached to an interior of the shell.

14. An improved golfball washing device including a shell having an outer wall which defines a cavity for holding liquid, a brush housing attached within the cavity to the outer wall, a plurality of brushes extending radially from the brush housing, a hollow post attached to the outer wall, an agitator mechanism movable with respect to the shell for bringing a golf ball into contact with the plurality of brushes, and a cover attached to the shell for closing a top portion of the cavity, the cover having an opening through which the agitator mechanism passes, the improvement comprising:

an overflow passage having a first end connected to the cavity at a desired overflow level for receiving liquid, and a second end positioned below the first end for delivering liquid; and an enclosure directly connected to the second end of the overflow passage for receiving liquid from the overflow passage.

15. The improved golf ball washing device of claim 14 wherein the overflow passage is a tube.

16. The improved golf gall washing device of claim 14 wherein the second end of the overflow passage communicates with the hollow post.

17. A method of manufacturing a golfball washing device including:

forming a shell having a side wall and a cavity for holding liquid, wherein the sidewall includes an overflow passage, wherein a first end of the overflow passage extends through the side wall and is connected to the cavity at a desired overflow level and further wherein a second end of the overflow passage is positioned below the first end to deliver liquid;

forming an enclosure directly connected to the second end of the overflow passage for receiving liquid from the overflow passage;

inserting a movable agitator mechanism into the shell for maneuvering a golfball within the cavity.

18. The method of manufacturing a golf ball washing device of claim 17, further including:

connecting a post having a hollow portion to the side wall such that the second end of the overflow passage communicates with the hollow portion of the post.

19. The method of manufacturing a golf ball washing device of claim 17 wherein the overflow passage is a tube which is encompassed by the side wall.

20. The method of manufacturing a golf ball washing device of claim 17, further including:

forming a lip on an interior portion of the side wall, wherein the lip is positioned at the desired overflow level and defines the first end of the overflow passage.

* * * * *